US005392798A

United States Patent [19]

Hirose et al.

[11] Patent Number: 5,392,798

[45] Date of Patent: Feb. 28, 1995

[54] CLEANING APPARATUS FOR INNER SURFACE OF A TANK

[75] Inventors: Susumi Hirose; Masatoshi Ishizaki; Yoshimitsu Funawatashi; Yukihiro Funakawa, all of Toyama, Japan

[73] Assignee: Kabushiki Kaisha Sugino Machine, Uozu, Japan

[21] Appl. No.: 83,764

[22] Filed: Jun. 30, 1993

[30] Foreign Application Priority Data

Jun. 30, 1992 [JP] Japan ..... 4-051356[U]

[51] Int. Cl.[6] ..... B08B 3/02; B08B 9/08

[52] U.S. Cl. ..... 134/167 R; 239/261; 239/265

[58] Field of Search ..... 134/167 R, 168 R, 171, 134/172, 179; 118/317; 239/256, 261, 265

[56] References Cited

U.S. PATENT DOCUMENTS 2,218,625 10/1940 Rudigier ..... 134/167 R X
3,542,593 11/1970 Pribbernow ..... 134/167 R X
3,880,359 4/1975 Novy ..... 134/168 R X
3,985,572 10/1976 Petermann et al. ..... 134/167 R X
5,107,879 4/1992 Harvey ..... 134/167 R

FOREIGN PATENT DOCUMENTS 2409759 9/1975 Germany ..... 134/167 R
54-57215 5/1979 Japan .
889129 12/1981 U.S.S.R. ..... 118/317

*Primary Examiner*—Philip R. Coe
*Attorney, Agent, or Firm*—Jacobson, Price, Holman & Stern

[57] ABSTRACT

A pair of expansion links each having a rotary jet nozzle are respectively expanded in the opposite two directions in synchronism with each other within a tank. With these link mechanisms capable of expansion and contraction, the link arms forming the links can be closed until the link arms are parallely adjoined to one another. The link mechanisms are driven by a driving shaft from outside the tank. The inner surface of the tank is scanned with streams of water sprayed from the nozzles along with the expansion of the expansion links thereby cleaning the inner surface of the tank.

7 Claims, 2 Drawing Sheets

CLEANING APPARATUS FOR INNER SURFACE OF A TANK

BACKGROUND OF THE INVENTION

1. Field of the Invention

The present invention relates to cleaning apparatus for the inner surface of a tank and more particularly to such cleaning apparatus of the type whereby the inner wall surface of a tank is scanned with a sprayed cleaning liquid sprayed from a pair of rotary jet nozzles introduced into the tank.

2. Description of the Prior Art

Tanks of the type carried for example on a railway tank car for the transportation of oils, high-molecular resin raw materials, edible oils, chemical fertilizers or the like has an oblong external appearance and is provided with only a single manhole in the top portion of the substantially central part thereof. In the past, when cleaning the inner surface of such tank, a manual operation has been solely employed so that an operator enters into the tank through the manhole to operate a hand-held water jet nozzle and therefore there has been the disadvantage that the operator is placed in a hazardous environment involving a full possibility of the operator being subjected to the danger of suffocation, poisoning by gas, mechanical injury-and the like, that the efficiency of the operation within the limited tank is deteriorated due to any mechanical interference between the operator itself as well as the hand-held equipment and the tank inner surface, and that there is the danger of any contaminative substance being brought into the tank by the operator itself. These deficiencies are commonly encountered in the case of various containers where a number of dead angles are caused within the container by the external operation alone due to the inadequate positions and number of the manholes, e.g., in the cleaning of flat-type tanks carried on tank lorries and various reaction vessels used in chemical plants.

Japanese Patent Laid-Open Publication No. SHO 54-57215 discloses an apparatus of the type designed for automatically cleaning the inner surface of a horizontal tank without having recourse to any manual operation, said apparatus being provided with a support member which is positioned to fit in an opening formed in the wall surface of a tank, and a rotary jet nozzle which is dependent from the support member to spray a cleaning liquid whereby the rotary jet nozzle is introduced into the tank through the opening to scan the inner wall surface with the cleaning liquid. This known apparatus uses the rotary jet nozzle of the type in which a nozzle head resolving on its axis is caused to orbit about the axis of orbital rotation which is perpendicular to the axis of revolution and its sprayed stream is scanned in all the directions around it. This rotary jet nozzle is arranged at the forward end of the expansion-mechanism which expands and contracts in a telescopic manner. When positioning the support member in the opening of the tank, the expansion mechanism is passed through the opening while being placed in its contracted condition just below the support member and then it is spread out in the longitudinal direction of the tank within the tank thereby placing it in an extended condition. In this way, the rotary jet nozzle introduced into the tank through the top opening is adjusted in position in the longitudinal direction of the horizontal tank within thereof thereby causing a sprayed stream to reach the dead angle positions within the tank.

With this known cleaning apparatus, the telescopic expansion mechanism, the drive unit (the hydraulic cylinder) of the expansion mechanism and the turning unit for spreading out the expansion mechanism between just below the support member and the longitudinal direction of the tank are brought into the tank and their associated mechanisms interfere with the opening in the limited opening of the tank. Thus, it will be extremely difficult to move out these mechanisms to the outside if the expansion mechanism becomes faulty within the tank. Also, due to the fact that the expansion mechanism and the turning unit are independently of each other, they use a large number of component parts and are complicated in construction and it is difficult to discriminate the current rotary position and length of expansion of the expansion mechanism from the outside of the tank. Further, since the expansion mechanism is suspended from the support member into the tank and in this condition it supports at the forward end thereof the rotary jet nozzle in a cantilever manner, when the expansion mechanism is extended, the moment acting on the base portion of the support member due to the reaction force of the rotary jet nozzle is increased rapidly and thus the whole apparatus is caused to vibrate heavily. As a result, there is less possibility of realizing a large-capacity. rotary jet nozzle tending to involve a large spray reaction force and its expansion mechanism tends to easily cause a fault. Still further, the support member must be fastened firmly to the tank for the prevention of vibrations and the structure for supporting the expansion mechanism on the support member is made bulky thus increasing interference of the component members of the cleaning apparatus. Thus, the apparatus of this type cannot be applied to tanks other than those having a considerably large opening.

SUMMARY OF THE INVENTION

It is the primary object of the present invention to provide a cleaning apparatus which is capable of employing large-capacity rotary jet nozzles, reducing the vibrations of the apparatus even if the rotary jet nozzles are moved considerably in the longitudinal direction of a tank, reducing the interference of the members in the opening of the tank and thus eliminating the need to increase the size of the opening of the tank.

It is another object of the present invention to provide such cleaning apparatus which is capable of easily discriminating the current positions of the rotary jet nozzles within the tank from the outside of the tank and easily removing the rotary jet nozzles to the outside of the tank even in the case of a failure within the tank.

In accordance with one aspect of the present invention, there is thus provided an apparatus for cleaning the inner surface of a tank, which comprises a support member adapted to be positioned in the opening formed in the wall surface of the tank to fit in the opening, a pair of expansion links which are supported on the support member so as to be respectively expandable in the opposite two directions in synchronism with each other within the tank, a pair of jet nozzles respectively arranged on the pair of expansion links to spray a cleaning liquid, and drive means for causing each of the expansion links to make expansion and contraction movements at its location of support by the support member.

In accordance with a preferred aspect of the present invention, the drive means includes a driving shaft inserted from the support member into the tank so as to be subjected to expansion and contraction movements and a drive mechanism for driving the driving shaft from the outside of the tank to make expansion and contraction movements whereby each of the expansion links is expanded in a direction substantially perpendicular to the direction of expansion and contraction of the driving shaft in association with the expansion and contraction movements of the driving shaft.

In accordance with another preferred aspect of the present invention, each of the expansion links includes a series-connected link composed of the same number of crossed link elements on one side of the supporting location of the expansion links by the support member and each of the crossed link elements is composed of a pair of link arms which are interconnected by a pivot at the intermediary position in the length direction of the link arms. Each of the jet nozzles is attached to the forward end of one of the series-connected links.

With the tank cleaning apparatus according to the present invention, the pair of expansion links each having the rotary jet nozzle arranged at the forward end thereof are respectively expanded in the opposing two directions relative to the support member in synchronism with each other. Therefore, the moments due to the weights of the rotary jet nozzles and their support mechanisms (the expansion links) are cancelled at the location of support by the support member so that essentially the support member is required to bear the downwardly acting weights of the rotary jet nozzles and their support mechanisms. Also, since the expansion links are expanded in the relatively opposing two directions within the tank, the moment of inertia of the support mechanisms on the whole is increased so that the moments acting on the support member due to the spray reactions from the pair of rotary jet nozzles are caused to cancel each other and the vibrations of the mechanisms on the whole are reduced. It is to be noted that while the pair of expansion links may be arranged back to back along the straight line in the direction of expansion, they may be placed one upon another in a direction perpendicular to the direction of expansion so as to be easily passed through the opening of the tank.

In accordance with another aspect of the present invention, a tank cleaning apparatus is provided in which the expansion and contraction movements of a pair of expansion links are effected by a driving mechanism arranged on the outer side of a tank and a driving force is transmitted to the expansion links by a driving shaft which is caused to make its expansion and contraction movements through an opening of the tank. Thus, in the condition where the cleaning apparatus is set in the opening of the tank, the opening is occupied by those members substantially comprising only a bundle of a pair of rotary jet nozzles, a pair of contracted expansion links serving as nozzle support mechanisms, structural members for suspending these weights and the driving shaft. In order that the pair of expansion links may be driven by the driving shaft so as to be respectively expanded in the opposing two directions in synchronism with each other, it is possible to reduce the possibility of causing these members to interfer mechanically with the opening during the passage of the bundle through the opening if the pair of expansion links are placed one upon another in a direction perpendicular to the expansion direction and the driving shaft is arranged at an intermediary position therebetween.

In accordance with still another aspect of the present invention, the tank cleaning apparatus is designed so that each of the expansion links includes a series-connected link composed of the same number of crossed link elements on one side of the supporting location of the expansion links by the support member and each of the crossed link elements is composed of a pair of link arms interconnected by a pivot at an intermediary position in the lengthwise direction of the link arms. Each of the rotary jet nozzles is attached to the forward end of one of the series-connected links. In other words, the expansion link forms a link mechanism of the same type as lazy tongs so that its legs can be shut until the respective pairs of link arms each forming a crossed link element are adjoined parallel to one another, and each of the rotary jet nozzles is moved within the tank by the expansion link composed of such link mechanism. With this link mechanism, the rotary jet nozzle can be guided to any given spread position by varying the crossing angle of the pair of link arms positioned closest to the support member side by the driving shaft, so that on one side, the whole expansion links can be folded in a compact manner for the passage through the opening of the tank thereby reducing the possibility of the occurrence of mechanical interference between the expansion links and the opening, while on the other hand, the desired large expansion strokes and the required sufficient rigidity can be obtained when respectively expanding the pair of expansion links in the opposing two directions in synchronism with each other. The position adjustment of the rotary nozzle jet within the tank can for example be controlled by the driving shaft caused to make an expansion or contraction movement through the opening of the tank and at this time the moved position of the rotary jet nozzle can be discriminated in accordance with the expanded or contracted condition of the driving shaft.

Thus, in accordance with the tank cleaning apparatus of the present invention the support member is merely required to share the downwardly acting weights of the rotary jet nozzles and their supporting mechanisms irrespective of the spreading distance of the expansion links and therefore the mechanism for holding the support member in the opening of the tank can be made simple even in cases where large rotary jet nozzles are spread in great amounts. Further, since the moment of inertia of the supporting mechanisms on the whole is large and the moments acting on the support member due to the spraying reactions of the pair of rotary jet nozzles cancel each other, the vibrations of the mechanisms on the whole can be made small even if large-capacity rotary jet nozzles are employed.

Still further, in accordance with the tank cleaning apparatus of the present invention the principal mechanisms governing the series of operations of extensively spreading the rotary jet nozzles within the tank from their folded conditions attained to reduce the possibility of the occurrence of mechanical interference with the tank opening during the introduction of the rotary jet nozzles into the tank and then placing the nozzles again in the original folded conditions after the completion of the cleaning are arranged outside the tank excluding the driving shaft and, with the cleaning apparatus installed in the opening of the tank, the components placed in the passage space of the opening are essentially limited to only the structural members for suspending the weights of the rotary jet nozzles and the expansion links serving as supporting mechanisms of the former and the driving shaft. Thus, there is the effect of extremely reducing the possibility of the occurrence of mechanical interference between the component parts of the cleaning apparatus and the opening within the opening, reducing the number of the component parts as well as the possibility of failure of the mechanisms and making it easy to ensure a space required for effecting the desired repair work in the event of any failure of the mechanisms, a space required for the wiring of a television camera for observing the interior of the tank, etc.

Still further, in accordance with the tank cleaning. apparatus of the present invention the mechanisms for the series of operations of extensively spreading the rotary jet nozzles within the tank from their folded conditions attained for their introduction into the tank and then restoring them into the original folded conditions after the completion of the cleaning are made up of the reduced number of component parts and the link assemblies of the simple pivoted construction and therefore there is the effect of reducing the weight of the mechanisms on the whole while ensuring the required rigidity even if a large spreading stroke is set and making it possible to accurately and easily effect the guiding and positioning of the rotary jet nozzles within the tank. The expansion links composed of such link mechanisms can be combined with the driving shaft adapted to be moved for expansion and contraction through the opening of the tank to increase the reliability further.

The above and other objects, features and advantages of the present invention will become more apparent from the following description of its preferred embodiments without any intention of limitation when taken in conjunction with the accompanying drawings.

DESCRIPTION OF THE PREFERRED EMBODIMENTS

Figure 1:
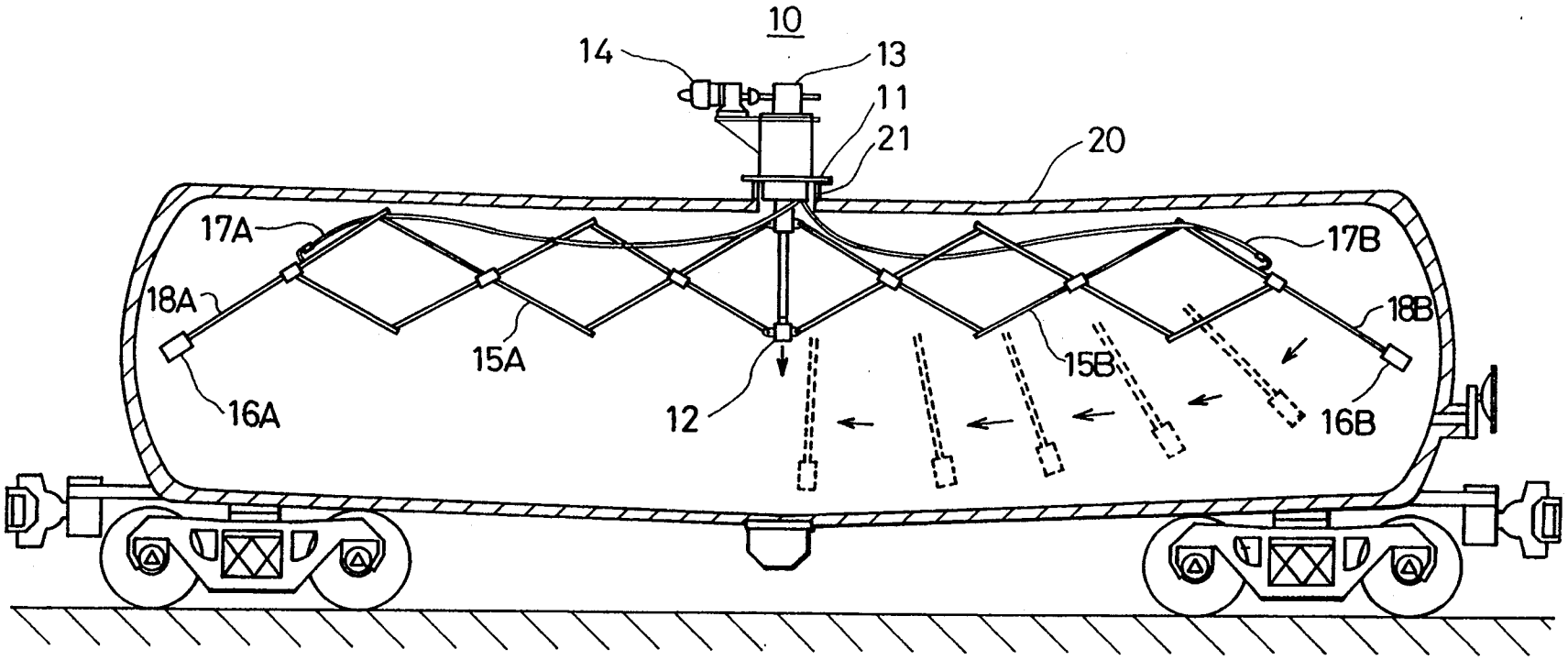
FIG. 1 illustrates a tank cleaning apparatus according to an embodiment of the present invention, showing the manner in which the apparatus is installed on a tank of a railway tank car.

Referring to FIG. 1, designated generally at a reference numeral 10 is a cleaning apparatus which is detachably installed in a manhole 21 of a tank 20. The cleaning apparatus 10 is provided with a base plate 11 extended in the form of a collar to serve as a support member by which the cleaning apparatus 10 is supported on the manhole 21, and the cleaning apparatus 10 is supported on the manhole 21 with the base plate 11 mounted on the edge of the manhole 21.

The cleaning apparatus 10 is provided below the base plate 11 with a first expansion link 15A adapted to be expanded to the left in FIG. 1 and a second expansion link 15B adapted to be expanded to the right. A first rotary jet nozzle 16A is attached to the forward end of the first expansion link 15A and a second rotary jet nozzle 16B is attached to the forward end of the second expansion link 15B.

Each of the expansion links 15A and 15B forms a series-connected link composed of the same number of crossed link elements, and each of the crossed link element is composed of a pair of link arms interconnected by a pivot at an intermediary position in the lengthwise direction of the arms. Pipes 18A and 18B are respectively fastened to the forward ends of the expansion links 15A and 15B, and the rotary jet nozzles 16A and 16B are respectively attached to the forward ends of the pipes.

The cleaning apparatus 10 further includes a fluidic power cylinder unit 13 mounted on the top of the base plate 11 and a motorized fluid pump 14 for supplying a working fluid to the cylinder unit 13, and a piston rod 12 of the cylinder unit 13 is inserted into the tank 20 through the base plate 11 so as to function as a driving shaft capable of making expansion and contraction movements within the tank 20. In other words, the cylinder unit 13 and the pump 14 form a driving mechanism for driving the driving shaft 12 from the outside of the tack to make expansion and contraction movements and the expansion links 15A and 15B are each caused to expand or contract in synchronism with each other in a direction substantially perpendicular to the direction of expansion and contraction of the driving shaft 12 in response to an expansion or contraction movement of the driving shaft 12.

The amount of expansion or the amount of contraction of each of the expansion links 15A and 15B within the tank 20 can be controlled in accordance with the crossing angle between the pair of link arms forming the crossed link element closest to the central driving shaft 12 or the amount of expansion or contraction of the driving shaft relative to the base plate 11. For this purpose, the flow rate of the working fluid supplied to the cylinder unit 13 from the pump 14 on the outside of the tank is controlled by for example the drive motor of the pump 14 or a flow control valve which is not shown. As the result of such control, the rotary jet nozzle 16B is guided to any of the positions indicated by dotted lines in FIG. 1 and at this time the rotary jet nozzle 16A is also guided to the position symmetrical to the rotary jet nozzle 16B in synchronism therewith.

Where the expansion and contraction of the driving shaft 12 are controlled externally of the tank, the shift in position (the amount of movement) of the driving shaft 12 may be detected by a suitable sensor in accordance with the amount of expansion or contraction of the piston rod of the cylinder unit 13 so that the result of the detection is used for comparison with the maximum amount of expansion predetermined in correspondence to the size of the tank 20 in a well-known electronic control unit (not shown) for the control of the working fluid and thus the expansion and contraction of the expansion links 15A and 15B are automatically controlled by position and/or speed feedback control.

A high-pressure water which is to be sprayed from the rotary jet nozzles 16A and 16B is supplied to the water inlet ports (not shown) formed in the base plate 11 from an external high-pressure water source (not shown) and the high-pressure water is supplied from these water inlet ports to the rotary jet nozzles 16A and 16B through high pressure conduit hoses 17A and 17B and pipes 18A and 18B, respectively.

Figure 2:
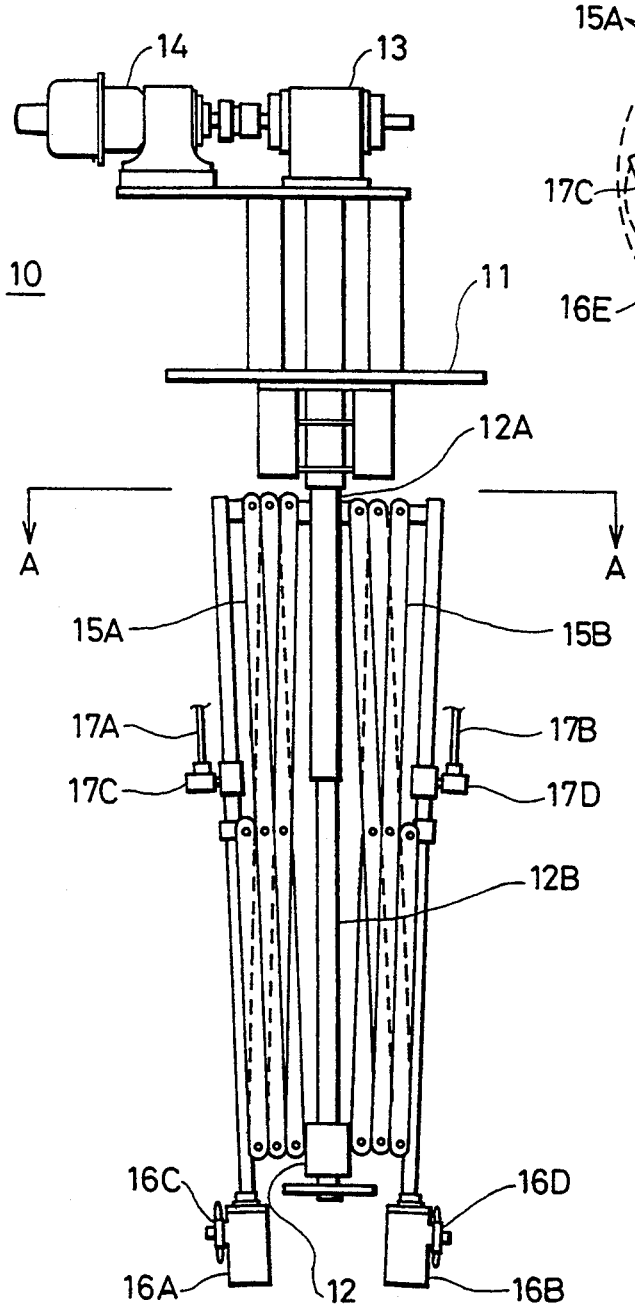
FIG. 2 illustrates the tank cleaning apparatus according to the embodiment of FIG. 1 in which the link mechanisms are contracted.
Figure 3:
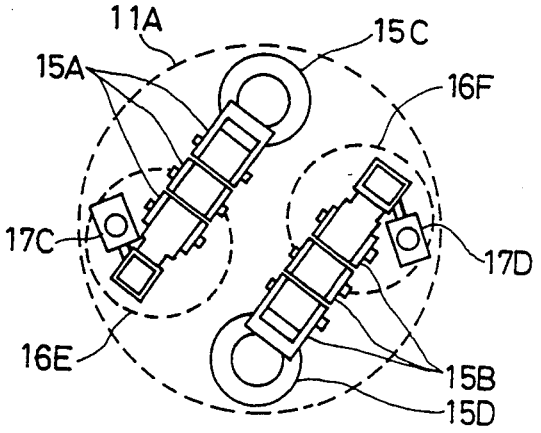
FIG. 3 is a schematic view looked in the direction of the arrowed line A—A of FIG. 2.

As shown in FIGS. 2 and 3, the rotary jet nozzles 16A and 16B are respectively provided in the form of nozzle blocks mounted on the forward ends of the pipes 18A and 18B so as to be rotatable about the axial centers thereof, and nozzle heads 16C and 16D for spraying the high pressure water supplied from the pipes 18A and 18B through the blocks are respectively attached to the blocks so as to be rotatable around their own axes which are perpendicular to the axial centers of the pipes. In other words, these nozzle heads are not only rotatable around their own axes but also adapted to orbit around the axes of orbit (or the axial centers of the pipes 18A and 18B) which are perpendicular to their axes of rotation and therefore the rotary jet nozzles 16A and 16B of this embodiment are of such type which are capable of scanning the surface to be cleaned while changing the directions of the sprayed streams of high pressure water to all directions around them in response to their rotations around their own axes and their orbital rotations.

Each of the nozzle heads 16C and 16D has the same construction as a fluid motor which rotates on its own axis in response to the reaction of the high pressure water supplied into the nozzle head 16C or 16D, and each of the rotary jet nozzles 16A and 16B is provided in its block with an orbital mechanism which receives the rotation of the nozzle head 16C or 16D through an operatively associated gear so as to rotate relative to the pipe 18A or 18B. The speeds of the rotation and orbital rotation of the nozzle heads 16C and 16D can be adjusted by incorporating a suitable orifice element in the high pressure water path formed in the block of each of the rotary jet nozzles 16A and 16B. The construction perse of the rotary jet nozzles of such type is disclosed for example in Japanese Utility Model Laid-Open Publication No. SHO 63-115452.

As shown in FIG. 2, the cylinder unit 13 driven by the pump 14 includes a pair of guide rods each arranged parallel to its piston rod (the driving shaft 12) and consisting of a tubular fixed part 12A and a movable part 12B telescopically slidable into and out of the fixed part 12A and the guide rods are shown at reference numerals 15C and 15D in FIG. 3. The upper ends of the fixed parts 12A of the guide rods 15C and 15D are fastened to the base plate 11 and their positions are the positions of twelve and six o'clocks in FIG. 3. Also, the lower ends of the movable parts 12B of the guide rods 15C and 15D are fastened to the lower end of the driving shaft 12.

Each of the expansion links 15A and 15B is constructed so that the pair of link arms forming the innermost-side crossed link element has one of the arms pivotably attached to the fixed part 12A of the guide rod 15C or 15D and the other arm pivotably attached to the moving part 12B of the corresponding guide rod 15C or 15D.

The pipes 18A and 18B are respectively fastened to the outermost-side ends of the expansion links 15A and 15B and the pipes 18A and 18B are respectively formed with ports 17C and 17D respectively connected to the forward ends of the high pressure hoses 17A and 17B. The high pressure water supplied to the ports 17C and 17D from the high pressure hoses 17A and 17B is directed to the rotary jet nozzles 16A and 16B through the channels in the pipes 18A and 18B of that a part of its energy is utilized for the previously mentioned rotation and orbital rotation and the high pressure water is finally sprayed from the nozzle heads 16C and 16D.

While the expansion links 15A and 15B are shown as arranged in a plan in FIGS. 1 and 2, respectively, for the purpose of facilitating the understanding, the expansion links 15A and 15B are actually arranged such that they are partly superposed on each other along with the driving shaft 12 in a direction perpendicular to the paper plane of FIG. 2 as shown in FIG. 3. Thus, when the expansion links 15A and 15B in the folded conditions are moved in and out of the tank through the opening (the manhole) of the tank, the expansion links 15A and 15B are bundled so as-to reduce as far as possible the occurrence of mechanical interference between the bundle and the tank opening or so as to make the bundle as small as possible. FIG. 3 shows by a broken line a circle 11A corresponding to a manhole of the minimum diameter which permits the insertion of the cleaning apparatus, and shown inside the circle 11A are the expansion links 15A and 15B in the folded conditions and possible interference regions 16E and 16F of the rotary jet nozzles 16A and 16B, respectively.

It it to be noted that it is desirable to provide a bypass valve which selectively communicates the cylinder chambers on both sides of the cylinder unit 13 and this has the effect of selectively making free the movement of the piston rod (the driving shaft 12). In other words, in the event that any structure within the tank 20 is caused to interfer and engage with the pipes 18A and 18B, for example, it is conceivable that it becomes impossible for the expansion links 15A and 15B to expand or fold if the working torque due to the working fluid from the pump 14 is weak. However, by providing any means capable of making free the movement of the cylinder unit 13, it is possible to move the driving shaft 12 with a strong torque by a crank handle or winch and thereby to forcibly fold and remove the expansion links 15A and 15B to the outside of the tank.

What is claimed is:

1. A cleaning apparatus for an inner surface of a tank having an opening, said apparatus comprising:

a support member detachably mounted to the edge of said opening to support said apparatus on said tank;

a pair of expansion links having a lazy tongs structure of the same length and pivotably connected to said support member so as to be respectively expandable in opposite two directions within said tank in synchronism with each other;

a pair of rotary jet nozzle means each thereof being supported on one of said pair of expansion links to spray a cleaning liquid while changing the direction of the sprayed liquid in response to the rotation thereof; and driving means mounted on said support member for causing said pair of expansion links to make expansion and contraction movements at a supporting location of said pair of expansion links by said support member.

2. A cleaning apparatus according to claim 1, wherein said driving means includes a driving shaft adapted to be inserted from said support member into said tank to make expansion and contraction movements, and a driving mechanism for driving said driving shaft from outside of said tank to make expansion and contraction movements whereby each of said pair of expansion links is expanded in a direction perpendicular to the directions of expansion and contraction of said driving shaft in response to the expansion and contraction movements of said driving shaft.

3. A cleaning apparatus according to claim 1, wherein each of said pair of expansion links includes a series-connected link composed of the same number of crossed link elements on one side of said supporting location by said support member, each of said crossed link elements being composed of a pair of link arms interconnected by a pivot at an intermediate position in the lengthwise direction thereof, and wherein each of said rotary jet nozzles is attached to a forward end of one of said series-connected links.

4. An apparatus for cleaning an inner surface of a tank having a manhole in a substantially central portion in a lengthwise direction thereof, said apparatus comprising:

a base plate detachably supported on said manhole;

first and second expansion links adapted to be respectively expanded in opposite directions below said base plate, each of said first and second expansion links having a lazy tongs structure of the same length;

a first rotary jet nozzle attached to a forward end of said first expansion link;

a second rotary jet nozzle attached to a forward end of said second expansion link;

fluid power cylinder means mounted on an upper part of said base plate;

a fluid pump for supplying a working fluid to said cylinder means;

a driving shaft adapted to be driven by said cylinder means and movable in an axial direction below said base plate; and a connecting mechanism responsive to the axial movement of said driving shaft to expand and contract said first and second expansion links in synchronism with each other.

5. A cleaning apparatus according to claim 5, further comprising:

a first pipe for attaching said first rotary jet nozzle to the forward end of said first expansion link;

a second pipe for attaching said second rotary jet nozzle to the forward end of said second expansion link;

a first high pressure conduit means hose for introducing a high pressure water from outside of said tank and supplying said high pressure water to said first rotary jet nozzle through said first pipe; and a second high pressure conduit hose for introducing a high pressure water from outside of said tank and supplying said high pressure water to said second rotary jet nozzle through said second pipe.

6. A cleaning apparatus according to claim 5, wherein said first rotary jet nozzle is attached to a forward end of said first pipe so as to rotate about an axial center of said first pipe, said first rotary jet nozzle including a first nozzle head for spraying the high pressure water supplied through said first pipe, said first nozzle head being adapted to rotate on its own axis perpendicular to the axial center of said first pipe, and wherein said second rotary jet nozzle is attached to a forward end of said second pipe so as to rotate about an axial center of said second pipe, said second rotary jet nozzle including a second nozzle head for spraying the high pressure water supplied through said second pipe, said second nozzle head being adapted to rotate on its own axis perpendicular to the axial center of said second pipe.

7. A cleaning apparatus according to claim 6, wherein each of said first and second nozzle heads is rotated on its own axis in response to a reaction of said high pressure water passed therethrough, wherein said first rotary jet nozzle is rotated relative to said first pipe in response to the rotation of said first nozzle head on its own axis, and wherein said second rotary jet nozzle is rotated relative to said second pipe in response to the rotation of said second nozzle head on its own axis.

* * * * *